US005357864A

United States Patent [19]

Ohta et al.

[11] Patent Number: 5,357,864

[45] Date of Patent: Oct. 25, 1994

[54] OFFSET PRINTING APPARATUS WITH INK STORAGE DEVICE

[75] Inventors: Hideo Ohta, Tokyo; Masahiko Miyoshi, Ayase, both of Japan

[73] Assignee: Kabushikigaisha Tokyo Kikai Seisakusho, Tokyo, Japan

[21] Appl. No.: 665,547

[22] Filed: Mar. 7, 1991

[30] Foreign Application Priority Data

Mar. 9, 1990 [JP] Japan ..... 2-56569

[51] Int. Cl.[5] ..... B41C 1/00; B41F 31/06

[52] U.S. Cl. ..... 101/483; 101/148; 101/350; 101/363; 101/367

[58] Field of Search ..... 101/350, 141, 148, 451, 101/365, 366, 483, 485, 348, 349, 363, 364, 367

[56] References Cited

U.S. PATENT DOCUMENTS

| | | | |
|---|---|---|---|
| 2,894,452 | 7/1959 | Trisler | 101/148 |
| 4,048,919 | 9/1977 | Woods | 101/148 |
| 4,497,250 | 2/1985 | Dressler | 101/350 |
| 4,527,479 | 7/1985 | Dahlgren et al. | 101/350 X |
| 4,690,055 | 9/1987 | Fadner et al. | 101/350 X |
| 4,790,243 | 12/1988 | Grosshauser | 101/350 X |
| 4,864,925 | 9/1989 | Van Kanegan et al. | 101/141 |
| 5,012,737 | 5/1991 | Makino et al. | 101/350 |

FOREIGN PATENT DOCUMENTS

| | | |
|---|---|---|
| 63-57236 | 3/1988 | Japan . |
| 63-16522 | 5/1988 | Japan . |
| 1-113244 | 5/1989 | Japan . |

*Primary Examiner*—Edgar S. Burr
*Assistant Examiner*—Christopher A. Bennett
*Attorney, Agent, or Firm*—Foley & Lardner

[57] ABSTRACT

An offset printing apparatus provides good adhesion of ink onto the roller of the feeding route by efficiently fractionizing the dampening fluid supplied to the ink device. An ink device has an ink feeding route including an ink metering roller and an ink storage device whose distance toward the revolving direction of the upstream roller of said ink feeding route gradually decreases.

16 Claims, 2 Drawing Sheets

OFFSET PRINTING APPARATUS WITH INK STORAGE DEVICE

BACKGROUND OF THE INVENTION

1. Field of the Invention

The present invention relates to an offset printing apparatus provided with an ink device and a dampening fluid device. More particularly, the present invention relates to an offset printing apparatus which is a so-called keyless ink furnishing device without any means to control the quantity of ink supply for each area divided through the width of the printing plate.

2. Description of the Prior Art

A keyless ink device for an offset printing apparatus and an offset printing apparatus provided with a keyless ink device have many advantages in the process of printing as no adjustment of the ink supply in accordance with the image zone on the printing plate is necessary. Therefore, many types of such apparatuses are known. For example, Japanese Utility Model Publication No. 63-16522 entitled "Non-water ink furnishing device utilized for simplified offset printing" (hereinafter referred to as "Prior Art 1"), Japanese Patent Laid-Open Publication No. 63-57236 entitled "Ink immersing apparatus provided with no key of offset lithographic printing device" (hereinafter referred to as "Prior Art 2"), Japanese Laid-Open Publication No. 1-113244 entitled "Lithographic printing apparatus" (hereinafter referred to as "Prior Art 3") have been disclosed.

In detail, Prior Art 1 discloses an ink furnishing device comprising an ink pan having an overflow stopper which controls the reserve level of ink; a fountain roller revolving with a part immersed in the ink; a mesh roller with a doctor blade arranged between the fountain roller and a form roller in contact with the printing plate on the plate cylinder; an ink tank capable of reserving ink; a pipe with a dehydrating filter which drains the overflowed ink from the stopper; and a pipe with an ink pump, which feeds ink from the ink tank into the ink pan. In this ink furnishing device, the dampening fluid inserted into the ink pan from the printing surface is removed with the excess ink by way of passing through the dehydrating filter after overflowing from the overflow stopper, and thus the ink not affected by the dampening fluid is retained, and is resupplied to the surface of the printing plate.

Prior Art 2 discloses an ink immersing apparatus which comprises an ink pan provided with a tray having a stopper which defines the reserve level of the mixed fluid of ink and water (hereinafter referred to as "ink and others" in the explanation of the Prior Art 2) adjacent to the part reserving ink overflowed from the stopper; an ink pan provided with a device which feeds the mixture of ink and water along the full length of the tray, a pump device which connects the tray and the reserve part, and a device which can supply the new supplementary ink equivalent to the quantity consumed through printing; a pan roller which is spaced from the inner wall of the tray and which makes the ink or ink and others flow toward the stopper by revolving; a measuring roller which has a cell fixed to the pan roller and which accepts ink and others therefrom and then sends it out to the ink form roller; a scraping blade fixed to the place contacting the measuring roller at the place where the excess ink of the measuring roller is to be returned to the tray; and a measuring device of the quantity of ink for starting the device supplying the new supplementary ink for the ink pan.

As a preferred embodiment of the apparatus, the device has a constitution in which the reserve part has a capacity so that it maintains the quantity of the fluid of the ink and others to be 40% or less of the whole, a constitution in which the tray has a bow-shaped bottom which substantially matches the curve of the outer circumference surface of the pan roller, and a constitution in which the bottom of the tray is placed 6.3 mm ($\frac{1}{4}$ inch) to 25.4 mm (1 inch) apart from the surface of the pan roller. In this apparatus, the ink and others are supplied along the full length of the tray by the pump device and the ink and others are transferred to the reserve part by continuously overflowing from the stopper by the pump operation driven by the rotation of the pan roller, and the fluid in the ink can be maintained in a completely uniform quality, and thus the storage of the isolated water, which causes separation of the ink from the focused image zone of the measuring roller and the ink roller or the printing plate, can be removed.

Prior Art 3 discloses a lithography printing apparatus comprising a storage device used for storing and circulating the mixed fluid of ink and the dampening fluid (hereinafter referred to as "mixed fluid" in the explanation of Prior Art 3); an ink reservoir; a pump device, connected to the storage device and the ink reservoir, for the transfer of the mixed fluid from the storage device up to the ink reservoir; an ink supplying roller, arranged near the ink reservoir, for furnishing the mixed fluid from the ink reservoir; a metering roller, with a cell arranged to contact the ink supplying roller, for furnishing the mixed fluid from the ink supplying roller to the form roller; a scraping blade contacting the metering roller with a cell at the position where excess mixed fluid to be returned to the storage device is produced; a water sensor device connected in line with the pump device between the storage device and the ink reservoir so as to measure the quantity of water in the mixed fluid and to feedback an electric signal; a device responsive to the electric signal transmitted from the water sensor device in order to feed the predetermined quantity of the fresh ink and water as required for supplement the ink and dampening fluid consumed through the process of printing; and a device to supply the fluid, mixed with the ink and the water beforehand, to the printing plate. As a preferred embodiment of the apparatus, a device supplying mixed fluid where an ink reservoir is arranged inside of the storing device and the ink reservoir is substantially in a bow-shaped form which matches the shape of the ink supplying roller; a device supplying mixed fluid where the second scraping blade is arranged in contact with the metering roller with a cell at the position where the metering roller with a cell passes through contacting the form roller, and the storage device comprising a separate reserving hole, for storing the materials excluded from the metering roller with a cell by the second scraping blade. This separate reserving hole is connected with the pump device so as to make the operation thereof possible.

This apparatus thus supplies the quantity of ink, required for the division of ink and water to the printing plate, continuously supplementing ink to the dampening fluid consumed by adjusting the ratio of the ink and water, controlling the quantity of the ink and water by an appropriate sensor and water supplying device, in order to divide the images on the printing plate.

These prior arts have raised the following problems.

The keyless machine disclosed in Prior Art 1 is a good technology for offset printing. However, at present, it is not practical, because the quality of the dehydrating filter does not sufficiently meet the required level. The dehydrating filter thus does not last very long under continuous use, and the use of high viscosity ink is impossible.

In Prior Art 2, some improvements have been made, namely the movement of the ink on the tray in the ink pan has been improved, the capacity of the reserving portion has been enlarged, and the circulation of the ink between the reserving portion and the tray has been improved. These factors allow a more uniform dispersal of the dampening fluid inserted in the ink, thereby preventing a problem in the ink supply. Namely, in either of the rollers of the ink immersing device, especially in the pan roller, the dampening fluid is gathered partially in the ink. As a result, the surface becomes covered with a water layer and the adhesion of the ink thereto is obstructed. However, in this simple circulating operation, fractionization of the dampening fluid inserted into the ink is insufficient and therefore, prevention of the problems has not been completely realized.

Prior Art 3 discloses a device which supplies only the mixed fluid, adjusting the ink and dampening fluid to a predetermined ratio, but which does not supply ink and dampening fluid separately. It also supplies the ink and dampening fluid to the image zone and the non-image zone after separating on the surface of the printing plate or near the roller. Thus, the poor adhesion of the ink onto the roller by the water layer at the time of supplying ink and a dampening fluid, as pointed out in Prior Art 2, is avoided.

However, when the mixed fluid is supplied as described above, strict control of the mixing ratio is necessary in order to supply the quantity necessary on the surface of the printing plate. As the mixing ratio of ink and dampening fluid is continuously changeable during the printing operation due to the difference of quantity of the ink and dampening fluid consumed during ink printing and due to the return of the dampening fluid remaining in the image zone of the printing surface supplied from the supplying source through the roller, a method for completely uniformly mixing the ink and the dampening fluid and a water sensor for ink of good quality become necessary for measuring the change exactly.

Further, a method such as cooling the fluid for separating the ink from the dampening fluid is necessary in order to ensure the complete separation of the ink from the dampening fluid on the printing plate or the nearby roller.

As shown above, therefore, even in Prior Art 3, the constitution of the control parts are complicated. Thus, the possibilities of frequent breakdowns becomes higher and maintenance thereof becomes more complicated, resulting in high system cost.

BRIEF SUMMARY OF THE INVENTION

It is therefore an object of the present invention to provide an offset printing apparatus which is practical and has a simple constitution, and, which, by efficiently separating the dampening fluid supplied to the printing apparatus, can diminish the poor condition of adhesion of the ink onto the roller where the ink passes through, especially the roller at the upstream side in the passage of ink, and thus provide a stable and continuous supply of ink.

DETAILED DESCRIPTION OF THE PREFERRED EMBODIMENT

The preferred embodiment of this invention will be discussed in conjunction with the drawings.

Figure 1:
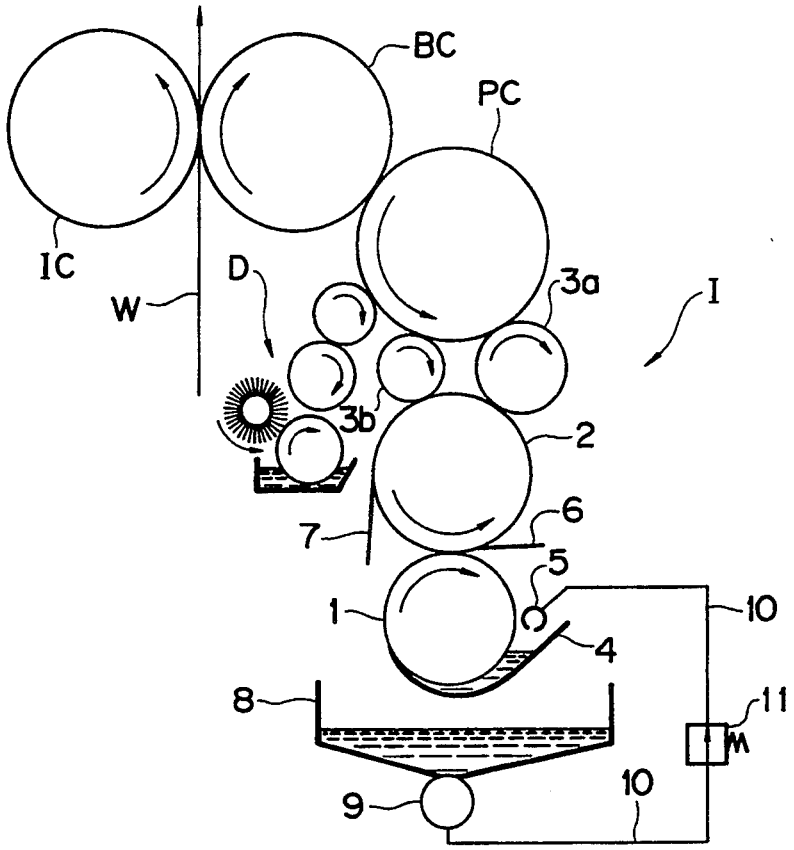
FIG. 1 and FIG. 2 are schematic illustrations showing the different embodiments of the present invention.
Figure 2:
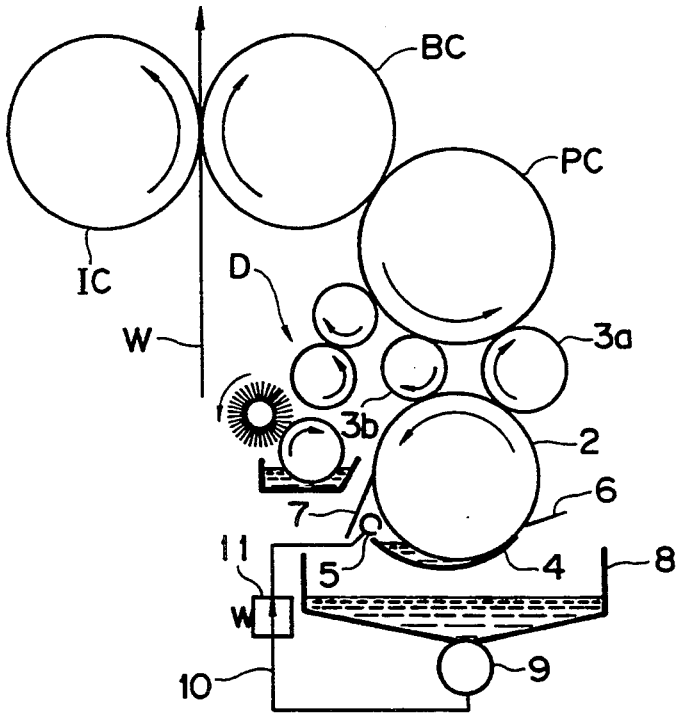

FIG. 1 and FIG. 2 schematically illustrate different embodiments of the offset printing apparatus. An offset printing apparatus comprises a blanket cylinder BC, a impression cylinder IC which presses a paper web W, inserted between the two blanket cylinders BC and IC, in cooperation with the blanket cylinder BC, a plate cylinder PC, an ink device I supplying ink to the image zone of the plate (not shown) fixed to the outer circumferential surface of the plate cylinder PC, and a dampening water device D supplying dampening fluid to the non-image zone of the printing plate. By such an offset printing apparatus, the image zone of the printing plate is printed on the paper web W through the surface of the blanket (not shown) fixed to the blanket cylinder BC.

In such an offset printing apparatus, the printing device I in the embodiment shown in FIG. 1 is constituted as follows.

The ink feeding route comprises a fountain roller (1), an ink metering roller (2) and ink form rollers (3)*a*, (3)*b*. In this apparatus, an ink fountain (4) is arranged substantially along the outer circumferential surface of the fountain roller (1) placed at the upstream side. The distance of the ink fountain (4) from the fountain roller (1) is narrower toward the downstream side of the revolution of the roller, and the length is long enough to cover the fountain roller (1). Also in this ink fountain (4), an ink nozzle (5) is arranged as an ink feeding device supplying ink substantially uniformly to the ink fountain (4) toward the longitudinal direction.

Further, a doctor blade (6), in contact with the full length of the ink metering roller (2), is provided around the outer circumferential surface of the ink metering roller (2) from the place where it passes the opposite part of the fountain roller (1) to the place where it meets with the outer circumferential surface of the ink form roller (3)*a*, (3)*b*.

Further, a doctor blade (7), in contact with the full length of the ink metering roller (2), is provided around the outer circumferential surface of the ink metering roller (2) from the place where it reaches the outer circumferential surface of the ink form roller (3)*a*, (3)*b* to the point where it meets with the outer circumferential surface of the ink metering roller (2).

Furthermore, an ink reservoir (8) is provided, beneath the ink fountain (4), which can store the ink scraped off by the doctor blade (6) and the second doctor blade (7). An ink feeding pipe (10) which connects the ink reservoir (8) and the ink nozzle (5) is also provided, with an ink pump (9) being on the pipe, as well as a pressing valve (relief valve) (11) (i.e. a safety valve) provided as a load device, on a section of the ink feeding pipe (10).

In the embodiment illustrated in FIG. 2, the ink device I is Without the fountain roller (1) shown in FIG. 1.

In this embodiment, therefore, an ink metering roller (2) replaces the upstream roller in the ink supplying route, and an ink fountain (4) is arranged substantially along the outer circumferential surface of the ink metering roller (2), making the distance of the ink metering roller (2) from the ink fountain (4) narrower toward the downstream side of the revolution of the roller (2), the length being long enough to cover the ink metering roller (2).

A typical operation of the embodiment will be described below.

Figure 5:
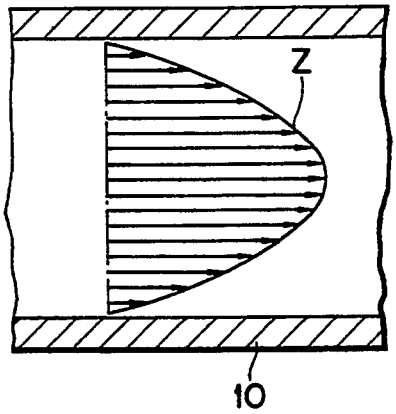
FIG. 5 illustrates the distribution of the speed of the ink transferred through the ink feeding pipe.

According to the above constitution, the ink stored in the ink reservoir (8) reaches the ink nozzle (5) through the ink feeding pipe (10) by the operation of the ink pump (9), and is thus supplied to the ink fountain (4). The ink inside the ink feeding valve (10) is transferred under laminar flow as illustrated in the distribution of the speed as Z in FIG. 5. In the ink reservoir (8) side, an appropriate pressure as fixed by the pressing valve (10) is applied. In the constitution without the pressing valve (not shown), such application of pressure by the pressing valve is not made. And, if there is excess ink supplied to the ink fountain (4), the ink will overflow from the ink fountain (4) and be stored in the ink reservoir (8).

Figure 3:
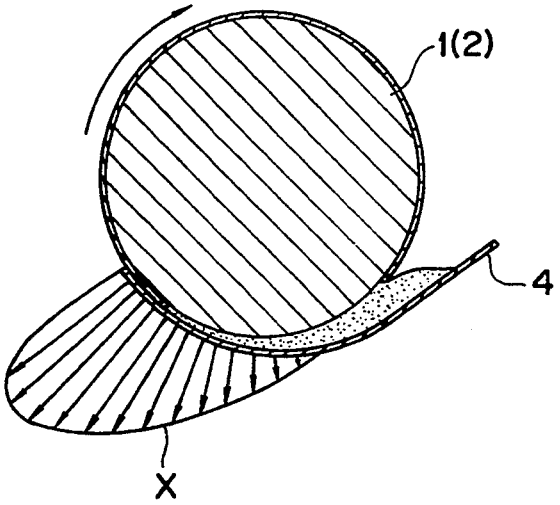
FIG. 3 illustrates the model of the distribution of the pressure operated onto the ink which swingingly moves according to the revolution of the fountain roller in the near space of the ink fountain and the fountain roller.

When the offset printing apparatus is operated under such circumstances, the ink in the ink fountain (4) is applied on the outer surface of the fountain roller (1) (in the embodiment shown in FIG. 2 "ink metering roller" (2)) according to the revolution of the fountain roller (1) (in the embodiment shown in FIG. 2 "ink metering roller") by the revolution of the fountain roller (in the embodiment shown in FIG. 2 "ink metering roller" (2)) , and the ink is supplied substantially uniformly around the outer surface of the fountain roller (1) (in the embodiment shown in FIG. 2 "ink metering roller" (2)). As the nearby space becomes narrower toward the downstream side of revolution of the fountain roller ( 1 ) ( in the embodiment in FIG. 2 "ink metering roller" ( 2 ) ) , the ink is gradually pressed according to the movement of the liquid back and forth. The pressure applied to the ink by the swinging movement changes as shown "X" in the distribution of pressure in FIG. 3. Such a swinging movement is made in the layer flow, the speed of which distributes as shown in FIG. 4 (*b*) or (*c*) .

In the embodiment illustrated in FIG. 1, the fountain roller (1) further transfers the ink supplied to the outer circumferential surface of the fountain roller ( 1 ) , by revolution, to the opposite portion of the fountain roller (1) and ink metering roller (2), and transfers the ink to the ink metering roller (2), which revolves in the direction opposite to the fountain roller (1).

The metering roller (2) where the ink is transferred (in the embodiment in FIG. 2, "metering roller" (2)) , by revolution, transfers the ink to the ink form roller (3)*a*, (3)*b*, in contact with the ink form roller (3)*a*, (3)*b* after the excess ink has been scraped off.

The ink form roller (3)*a*, (3)*b*, by revolution, contacts the printing plate (not shown) fixed to the outer circumferential surface of the plate cylinder PC, and supplies the ink transferred from the ink metering roller (2) to the image zone of the plate. At this time, the dampening water supplied to the non-image zone of the printing plate by the dampening means D prevents the transfer of the ink of the ink form roller (3)*a*, (3)*b* into the non-image zone.

The ink supplied to the image zone of the printing plate enables printing onto the paper web W through the surface of the blanket (not shown) fixed to the circumference of the blanket cylinder BC.

On the other hand, after contacting the printing plate, the dampening fluid is supplied from the non-image zone of the printing plate onto the circumference of the form roller (3)*a*, (3)*b*.

Thus, the dampening water supplied to the ink device I is transferred to the ink metering roller (2) contacting the ink form roller (3)*a*, (3)*b*. Accordingly, most of the dampening fluid, together with the excess ink stored in the outer circumferential surface of the ink metering roller (2) is scraped off by the second doctor blade (7) contacting the outer circumferential surface of the ink metering roller (2) after contacting ink form roller (3)*a*, (3)*b*, and is stored as mixed fluid with ink. Then, the dampening fluid is supplied to the ink fountain (4) as a mixed fluid with ink by the operation of the ink pump (9). The small quantity of the dampening fluid which has passed through the second doctor blade (7) reaches the ink fountain (4) through the circumference of the fountain roller (1) (in the embodiment in FIG. 2, "ink metering roller" (2)) and then mixes with ink.

In the constitution without the second doctor blade (7) (not shown), the dampening fluid supplied to the ink device I reaches the ink fountain (4) through the circumference of the ink metering roller (2) and the fountain roller (1), respectively, and is mixed with ink.

Next, the movement of the dampening fluid which was mixed with ink after being supplied to the ink device I, will be described in more detail.

As mentioned above, the dampening fluid, scraped off by the second doctor blade (7) together with the excess ink remaining on the outer circumferential surface of the ink metering roller (2), is mixed with the ink by a stirring operation along with a scraping and dropping action into the ink reservoir (8), splitted to some extent, and dispersed into the ink to form a mixed fluid with ink.

Then, the flow of mixed fluid becomes turbulent when the fluid through the ink pump (9), and the dampening fluid in the mixed fluid is further separated by the stirring operation caused by the turbulent flow. Here, the mixed state is improved. Thereafter, in the ink feeding pipe (10), the dampening fluid in the mixed fluid, by the layer flow state and the pressing operation by the pressing valve (11) is divided into quantities such that a balance between the outer pressure from the ink side and the inner pressure thereagainst is maintained, and then, as a mixed fluid in a well-dispersed condition, this dampening fluid is supplied to the ink fountain (4).

The mixed fluid supplied to the ink fountain (4) moves back and forth in the nearby space between the ink fountain (4) and the fountain roller (in the embodiment in FIG. 2, "ink metering roller" (2)) along the ink fountain (4) and the fountain roller (in the embodiment in FIG. 2, "ink metering roller" (2)), in accordance with the revolution of the fountain roller (1) (in the embodiment shown in FIG. 2, "ink metering roller" (2)). In such movement, the mixed fluid becomes in a state of laminar flow as stated above, and is pressed along with growing pressure. In other words, the ink supplied to the outer circumferential surface of the fountain roller (1) (in the embodiment in FIG. 2, "ink metering roller" (2)), which is the upstream roller in the ink feeding route, and/or the ink fountain (4) moves back and forth in a state of laminar flow in the nearby space between the upstream roller and the ink fountain (4) by the revolution of the fountain roller (1) (in the embodiment in FIG. 2, "ink metering roller (2)). As the distance between the outer circumferential surface of the upstream roller and the ink fountain (4) becomes smaller toward the downstream direction of the revolution of the upstream roller, the ink pressure moving back and forth in a state of laminar flow therebetween becomes higher toward the downstream direction of the upstream roller in the ink fountain (4), as shown in FIG. 3.

Figure 4A:
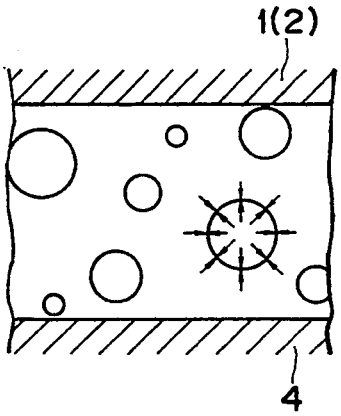
FIG. 4(*a*) to (*c*) is an illustration showing the process as a model where the dampening fluid in the ink is separated in said space nearby.
Figure 4B:
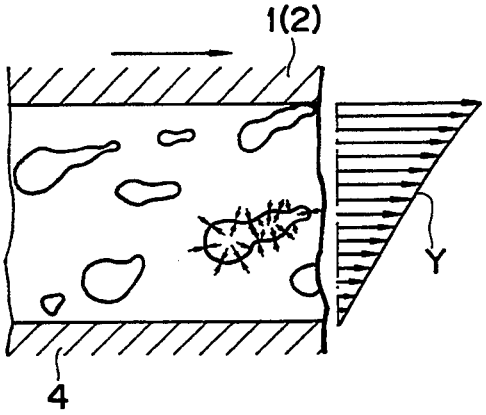
Figure 4C:
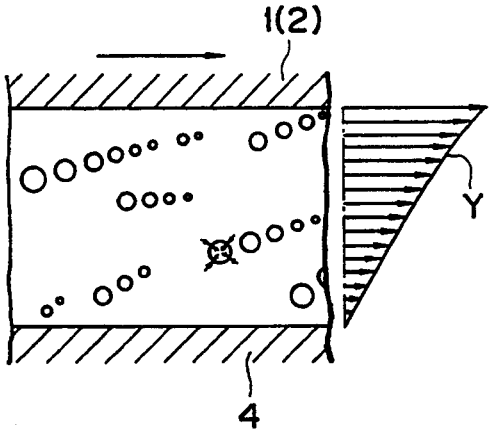

On the other hand, the dampening fluid in the ink under pressure becomes stable due to the inner pressure against the outer pressure operated by the ink side, as shown in FIG. 4(a), and notwithstanding its volume, the dampening fluid maintains a spheroidal in an appropriate form. While, however, the dampening fluid of large volume moves back and forth under pressure and in a state of laminar flow, as in the progressive narrowing space formed in the arc between the downstream roller and the ink fountain (4), this movement unstably transforms the ink in the direction of the ink flow due to the partial imbalance between the outer pressure and the inner pressure as shown in FIG. 4(*b*). In such a case, as shown in FIG. 4(*c*), the fluid is divided to the extent so that the spheroid or the stable form can be maintained and dispersed in a good and uniform condition, and then it is fixed to the outer circumferential surface of the fountain roller (1) in more uniform mixed fluid.

Thus, no collective part of the dampening fluid which only forms the water filter around the outer circumferential surface of the roller constituting the ink feeding route remains, and the ink supply to the printing plate becomes stable and the quality of the printing become necessarily improved.

In the constitution without the pressing valve (11), the efficiency of the division of the dampening fluid in the mixed fluid in the ink feeding pipe (10) becomes somewhat lower. In the constitution without the second doctor blade (7) (not shown), the dampening fluid supplied to the ink device I reaches the ink fountain (4) and is mixed with ink, by the transfer of the outer circumference of each of the ink metering roller (2) and the fountain roller (1). The dampening fluid is repeatedly separated at each transfer, without being scraped off by the second doctor blade (7), with the excess ink remaining on the circumferential surface of the ink metering roller (2), without division at the time of dropping into the ink reservoir (8), without division when passing through the ink pump (9), and without division when being transferred through the ink feeding pipe (10).

Therefore, in the constitution without the pressing valve (11) or without the second doctor blade (7), the dampening fluid in the mixed fluid just supplied to the ink fountain (4) and the dampening fluid mixed with ink in the ink fountain (4) is divided to a lower extent than the dampening fluid in the mixed fluid which is supplied to the ink fountain (4) shown in FIG. 1. However, the dampening fluid is divided enough and dispersed into the ink by the movement of the fluid back and forth in the nearby space between the ink fountain (4) and the fountain roller (1) (in the embodiment in FIG. 2, "ink metering roller" (2)).

Additionally, according to a test by the present applicant, the division of the dampening fluid mentioned above proved satisfactory where the minimum distance between the ink fountain (4) and the outer circumferential surface of the fountain roller (1) is less than 5 mm.

The practice of the present invention makes it possible to efficiently divide the dampening fluid supplied to the ink device by a very practical and simple constitution of a key-less offset printing apparatus. By avoiding an accumulation of the dampening fluid in the ink, the continuous ink supply to the roller on the ink feeding route, especially the upstream roller, has been realized without any poor adhesion of ink.

What is claimed is:

1. An offset printing apparatus comprising:

(A) an ink feeding route including an ink metering roller having a circumferential surface;

(B) a fountain roller having a circumferential surface which supplies ink to said circumferential surface of said ink metering roller;

(C) an ink storage device which supplies ink to said circumferential surface of said fountain roller along substantially the entire longitudinal length of said circumferential surface of said fountain roller, means for increasing the pressure of the ink against said fountain roller as said fountain roller progresses through said ink storage device, said means including spacing the ink storage device from said circumferential surface of said fountain roller such that the distance between said circumferential surface of said fountain roller and said ink storage device progressively decreases in the direction of rotation of said fountain roller along an arc of the circumferential surface of said fountain roller to a minimum distance at a downstream end of said arc;

(D) an ink feeding device which supplies ink to one of said fountain roller and said ink storage device;

(E) an ink form roller contacting said circumferential surface of said ink metering roller downstream of said fountain roller;

(F) a doctor blade contacting said circumferential surface of said ink metering roller at a point located upstream of said ink form roller;

(G) an ink reservoir;

(H) an ink feeding line connecting said ink reservoir and said ink feeding device;

(I) a pump located in said ink feeding route;

(J) a printing plate cylinder having a printing plate thereon, said printing plate having a non-image zone;

(K) a dampening device cooperating with said ink feeding route to supply dampening fluid to said non-image zone.

2. The apparatus according to claim 1, wherein said ink reservoir stores materials scraped off from said ink metering roller by said doctor blade.

3. The apparatus according to claim 1, further comprising a second doctor blade contacting said circumferential surface of said ink metering roller at a point located downstream of said ink form roller, wherein said ink reservoir stores materials scrapped off from said ink metering roller by said doctor blade and said second doctor blade.

4. The apparatus according to claim 1, further comprising a pressing valve applying pressure to ink supplied to said ink feeding device.

5. The apparatus according to claim 1, wherein said minimum distance is no greater than 5 mm.

6. An offset printing apparatus comprising:

(A) an ink feeding route including an ink metering roller having a circumferential surface;

(B) an ink storage device which supplies ink to said circumferential surface of said ink metering roller along substantially the entire longitudinal length of said circumferential surface, means for increasing the pressure of the ink against said ink metering roller as said ink metering roller progresses through said ink storage device, said means including spacing the ink storage device from said circumferential surface such that the distance between said circumferential surface and said ink storage device progressively decreases in the direction of rotation of said ink metering roller along an arc of the circumferential surface to a minimum distance at a downstream end of said arc;

(C) an ink feeding device which supplies ink to one of said ink metering roller and said ink storage device;

(D) an ink form roller contacting said circumferential surface of said ink metering roller downstream of said ink feeding device;

(E) a doctor blade contacting said circumferential surface of said ink metering roller at a point located upstream of said ink form roller;

(F) an ink reservoir;

(G) an ink feeding line connecting said ink reservoir and said ink feeding device;

(H) a pump located in said ink feeding route; and (I) a dampening device contacting said ink feeding route to supply dampening fluid thereto.

7. The apparatus according to claim 6, wherein said ink reservoir stores materials scraped off from said ink metering roller by said doctor blade.

8. The apparatus according to claim 6, further comprising a second doctor blade contacting said circumferential surface of said ink metering roller at a point located downstream of said ink form roller, wherein said ink reservoir stores materials scraped off from said ink metering roller by said doctor blade and said second doctor blade.

9. The apparatus according to claim 6, further comprising a pressing valve applying pressure to ink supplied to said ink feeding device.

10. The apparatus according to claim 6, wherein said minimum distance is no greater than 5 mm.

11. An offset printing apparatus comprising:

(A) an ink feeding route including a roller having a circumferential surface;

(B) an ink storage device which supplies ink to said circumferential surface of said roller, means for increasing the pressure of the ink against said roller as said roller progresses through said ink storage device, said means including spacing the ink storage device from said circumferential surface such that the distance between said ink storage device and said circumferential surface progressively decreases in the direction of rotation of said roller along an arc of said circumferential surface to a minimum distance at a downstream end of said arc; and (C) an ink feeding device which supplies ink to one of said roller and said ink storage device; and (D) a dampening device contacting said ink feeding route.

12. The apparatus according to claim 11, further comprising an ink reservoir communicating with said ink feeding device.

13. The apparatus according to claim 11, further comprising an ink reservoir, an ink feeding line connecting said ink reservoir to said ink storage device, and a pump located in said ink feeding line.

14. The apparatus according to claim 13, further comprising a pressing valve located in said ink feeding line.

15. A process comprising:

(A) rotating a roller having a circumferential surface;

(B) supplying ink to said roller via an ink storage device communicating with said circumferential surface of said roller;

(C) increasing the pressure of the ink against said roller as said roller progresses through said ink storage device by spacing the ink storage device from said circumferential surface such that the distance between said ink storage device and said circumferential surface progressively decreases in the direction of rotation of said roller along an arc of said circumferential surface to a minimum distance at a downstream end of said arc; and (D) supplying ink to one of said roller and said ink storage device;

(E) supplying ink from said roller to a plate cylinder roller; and (F) supplying dampening fluid to said plate cylinder roller via a dampening device.

16. An offset printing apparatus as recited in claim 1, wherein said dampening device contacts, aid printing plate.

* * * * *